US008842049B2

(12) United States Patent
Anand

(10) Patent No.: US 8,842,049 B2
(45) Date of Patent: Sep. 23, 2014

(54) CONNECTOR ASSEMBLY TO SUPPORT MULTIPLE ANTENNAS

(75) Inventor: Rajat Sandeshkumar Anand, Fremont, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 260 days.

(21) Appl. No.: 13/458,358

(22) Filed: Apr. 27, 2012

(65) Prior Publication Data

US 2013/0288615 A1 Oct. 31, 2013

(51) Int. Cl.
*H01Q 1/24* (2006.01)

(52) U.S. Cl.
USPC ..... 343/702; 343/906

(58) Field of Classification Search
CPC ..... H04B 1/40
USPC ..... 343/702, 906; 439/76.1, 579, 916; 455/77
See application file for complete search history.

(56) References Cited

U.S. PATENT DOCUMENTS

| | | | | |
|---|---|---|---|---|
| 5,701,128 | A * | 12/1997 | Okada et al. | 343/700 MS |
| 6,300,912 | B1 * | 10/2001 | Pla | 343/713 |
| 7,095,371 | B2 | 8/2006 | Monebhurrun | |
| 7,098,862 | B2 | 8/2006 | Regala | |
| 7,102,590 | B2 * | 9/2006 | Regala | 343/901 |
| 7,394,431 | B2 * | 7/2008 | Yanagi et al. | 343/702 |
| 7,478,759 | B2 * | 1/2009 | Lung | 235/492 |
| 7,965,246 | B2 | 6/2011 | Yanagi et al. | |
| 7,994,992 | B1 | 8/2011 | Tam et al. | |
| 2002/0109643 | A1 * | 8/2002 | Buckles | 343/893 |
| 2011/0221648 | A1 * | 9/2011 | Lee et al. | 343/826 |

OTHER PUBLICATIONS

Multi-band Trucker Antenna, Think Wireless, inc., retrieved from the Internet Apr. 26, 2012, http://www.thinkwireless.com/multiband_trucker_antenna.html.

* cited by examiner

*Primary Examiner* — Tho G Phan
(74) *Attorney, Agent, or Firm* — Ola Adekunle

(57) ABSTRACT

Example embodiments disclosed herein relate to a connector assembly that includes a plurality of antennas including a first antenna operating at a first frequency and a second antenna operating at a second frequency different from the first antenna. The SMA connector assembly also includes an SMA socket to mount the plurality of antennas on an SMA aperture of the computing device and a controller to select at least one antenna of the plurality of antennas corresponding to at least one operating frequency. Example methods and machine-readable storage media are also disclosed.

20 Claims, 7 Drawing Sheets

CONNECTOR ASSEMBLY TO SUPPORT MULTIPLE ANTENNAS

BACKGROUND

Advances in technology have resulted in many computing systems supporting multiple radio frequency (RF) technologies such as Wi-Fi, Bluetooth, global positioning system (GPS), near field communication (NFC), and the like. Depending on the RF technologies supported to be implemented on the system, multiple antennas may be required (i.e., one or more antenna for each RF technology). Businesses such as manufacturers and consumers of manufactured computing systems may be challenged to deliver state of the art computing systems, for example, by providing computing systems with multiple RF technology capabilities (and multiple antenna configurations) while maintaining a small or compact system chassis (i.e., space constraints). Further, manufacturers and consumers may want to upgrade legacy computing systems that do not provide for multiple RF technologies and multiple antennas to implement multiple RF technologies, without making expensive and time consuming modification to the legacy chassis.

BRIEF DESCRIPTION OF THE DRAWINGS

The following detailed description references the drawings, wherein.

DETAILED DESCRIPTION

Figure 1:
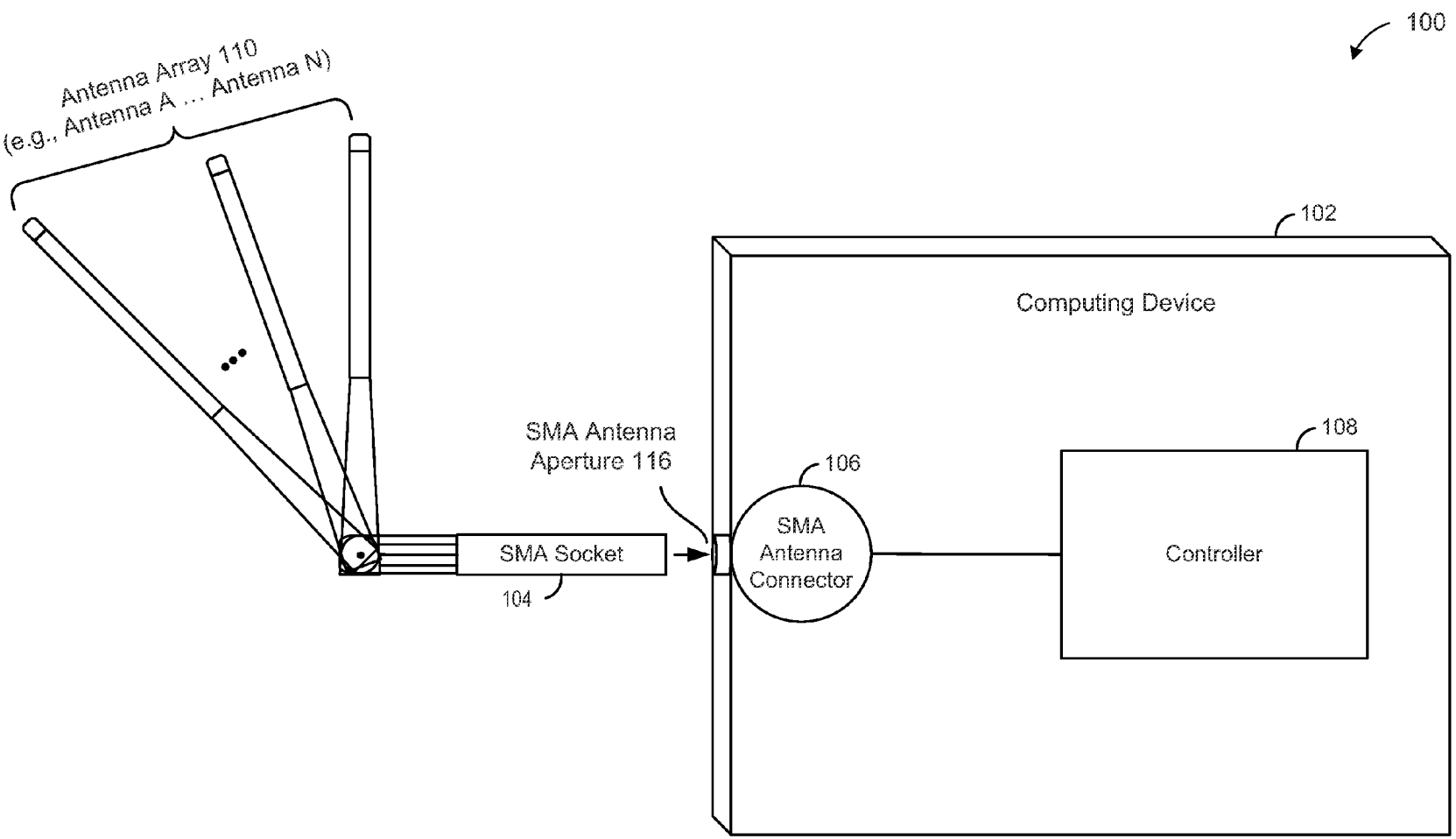
FIG. 1 is a block diagram of an example implementation of a subminiature version A (SMA) connector assembly for mounting and enabling multiple antennas mounted on an SMA aperture of a computing device using an SMA socket.

Multiple antennas may take up additional space on a computing system, resulting in an increased area of the chassis of the system. Further, each antenna may require a connector (e.g., a SubMiniature version A (SMA) connector) on the chassis of the system which may lead to an increase in signal losses due to the connectors. Thus, implementing multiple antennas to provide multiple RF technology on space constraint designs which do not permit mounting multiple antennas may be challenging. One solution may be to utilize embedded antennas. However, embedded antennas are fixed, require space for each embedded antenna inside the system, and may also require a plastic covering or bezel to protect each embedded antenna and to prevent signal interferences, thereby increasing the cost and dimension of the system. Another solution may be to provide additional SMA connectors on the system for each antenna to be mounted. However, this solution may not provide design flexibility and may not be scalable with an increasing need for more antennas once the system has been manufactured. In addition, SMA connectors may introduce signal losses due to the metal connectors and may result in increased cost as additional parts are added to the system.

Upgrading legacy system that do not provide for multiple RF technologies and multiple antennas may be challenging. Such upgrades may require expensive and time consuming modifications to the legacy chassis. Accordingly, it may be desirable to implement scalable multiple RF technologies via multiple antennas on a computing device without sacrificing cost, space, and performance.

Accordingly, as described in detail below, various examples relate to an SMA connector assembly that allows mounting multiple antennas using an existing SMA aperture present on legacy chassis or a space constraint design which does not allow mounting multiple antennas. The SMA connector assembly includes an SMA socket to mount a plurality of antennas onto an SMA aperture of a computing device, the plurality of antennas including a first antenna operating at a first frequency and a second antenna operating at a second frequency different from (or the same as) the first frequency. The SMA connector assembly also includes a controller to select at least one antenna of the plurality of antennas corresponding to at least one operating frequency (e.g., a desired operating frequency for a desired RF technology). The controller further to tune the at least one antenna to a particular operating frequency. Thus, the SMA connector assembly provides a scalable, flexible, and low cost means for implementing multiple RF technologies via multiple antennas.

In the description that follows, reference is made to the term, "machine-readable storage medium." As used herein, the term "machine-readable storage medium" refers to any electronic, magnetic, optical, or other physical storage device that stores executable instructions or other data (e.g., a hard disk drive, random access memory, flash memory, etc.).

Referring now to the drawings, FIG. 1 is a block diagram of an embodiment of a subminiature version A (SMA) connector assembly 100 for mounting and enabling multiple antennas on a computing device using an SMA socket, according to one example. Computing device 102 includes, for example, a controller 108 and an SMA antenna connector 106 having an SMA aperture 116 on the frame of the computing device 102. The SMA antenna connector 106 may be communicatively coupled to the controller 108, as Shown. Further, the SMA socket 104 may be mounted on the computing device 102 (and coupled to the SMA antenna connector 106) via the SMA antenna aperture 116. Thus, multiple antennas (e.g., antenna array 110) may be mounted onto the computing device 102 via the SMA aperture 116.

Computing device 102 may be, for example, a notebook computer, a desktop computer, a laptop computer, a handheld computing device, a mobile phone, a server, a router or gateway device, an access point, a slate or tablet computing device, a portable reading device, a personal digital assistant (PDA), an entertainment unit (e.g., a television), a multimedia device, or any other processing device.

Controller 108 may be a printed circuit board (PCB) or the like for controlling and managing components connected thereto. Controller 108 may include, or may be, a processor for executing instructions stored in a memory of the computing device 102, the instructions for controlling and managing components connected thereto. For example, the controller 108 may select at least one antenna of a plurality of antennas 110 mounted on the computing device 102 for communication. As another example, the controller 108 may tune the at least one antenna to a desired operating frequency for communication. Thus, the controller 108 may identify, manage, and configure the plurality of antennas 110 mounted on the computing device 102, the plurality of antennas 110 mounted using the SMA socket 104.

SMA antenna connector 106 may be a coaxial RF connector having a coupling mechanism (e.g., a mating plane) for connecting an antenna to the computing device 102. SMA antenna connector 106 may be a "male" having a center contact pin or a "female" connector having a sleeve for receiving the male contact pin. Further SMA antenna connector 106 may be a reverse polarity SMA (RP-SMA or RSMA), where the gender of the interface is reversed. For example, a male SMA antenna connector 106 may be connected to an antenna having a female SMA connector, and vice versa. Thus, as used herein, the SMA antenna connector 106 may include a regular SMA connector or a RP-SMA/RSMA connector.

The SMA socket 104 may include a fork-like multipronged structure having at least two prongs corresponding to a number of antennas to be mounted on the computing device 102. For example, the SMA socket 104 may include 3 prongs for mounting 3 antennas onto the computing device 102 via the SMA aperture 116. It should be noted that the SMA socket 104 is not limited to 3 prongs for mounting 3 antennas, but may include as many prongs for mounting as many antennas required for implementing multiple technologies. Thus, the SMA socket 104 provides design flexibility and scalability in mounting as many antennas needed for the computing device 102 to implement multiple RF technologies. The SMA socket 104 may include an SMA connector (e.g., at the base) to connect the SMA socket 104 to the SMA antenna connector 106 through the SMA antenna aperture 116. For example, the SMA socket 104 may include an opposite gender coupling mechanism different from the gender coupling mechanism of SMA antenna connector 116. To illustrate, if the SMA antenna connector 106 includes a female connector, the SMA socket 104 may include a male connector, or vice versa.

In one embodiment, the antenna array 110 is a plurality of antennas tunable to different operating frequencies by the controller 108. For example, a first antenna may be tuned to a Wi-Fi frequency band, a second antenna may be tuned to a Bluetooth frequency band, a third antenna may be tuned to a near field communication (NFC) frequency band, a fourth antenna may be tuned to a global system for mobile communications (GSM) frequency band, and so on. In another embodiment, two or more antennas may be tuned to the same frequency band. For example, two antennas may be tuned to the same frequency band to operate in two different channels of the same frequency band. To illustrate, in a 2.4 GHz WLAN frequency band having multiple frequency ranges corresponding to multiple WLAN channels, a first antenna may be tuned a first frequency range corresponding to a first channel of the WLAN and a second antenna may be tuned to a second frequency range corresponding to a second channel of the WLAN, such that the computing device 102 may transmit and receive WLAN signals more reliably.

Thus, the controller 108 may tune and/or select one or more antennas of the plurality of antennas 110 to implement one or more RF technologies. It should be noted that multiple RF technologies corresponding to multiple frequency bands may be implemented. In one embodiment, each of the plurality of antennas 110 may be a stick antenna including a thin coaxial cable that terminates with an ultra small coaxial connector. Further each antenna of the plurality of antennas 110 may transmit data signals, receive data signals, or a combination thereof. For example, the antenna array 110 may be coupled to a transceiver (not shown) so each antenna may function as both a transmitter and a receiver.

In addition to providing design flexibility for the computing device 102, scalability may also be achieved by removing RF technologies that are not configured for the computing device 102 and/or adding new RF technology by selecting and/or tuning one or more antennas to a desired operating frequency corresponding to the new RF technology. Further, legacy computing devices that support only a single antenna may be upgraded to support multiple antenna configurations without modification to the chassis of the computing device. For example, the SMA socket 104 (including the multiple antennas 110) may be mounted onto the legacy devices via the existing single SMA aperture on the legacy device.

Figure 2:
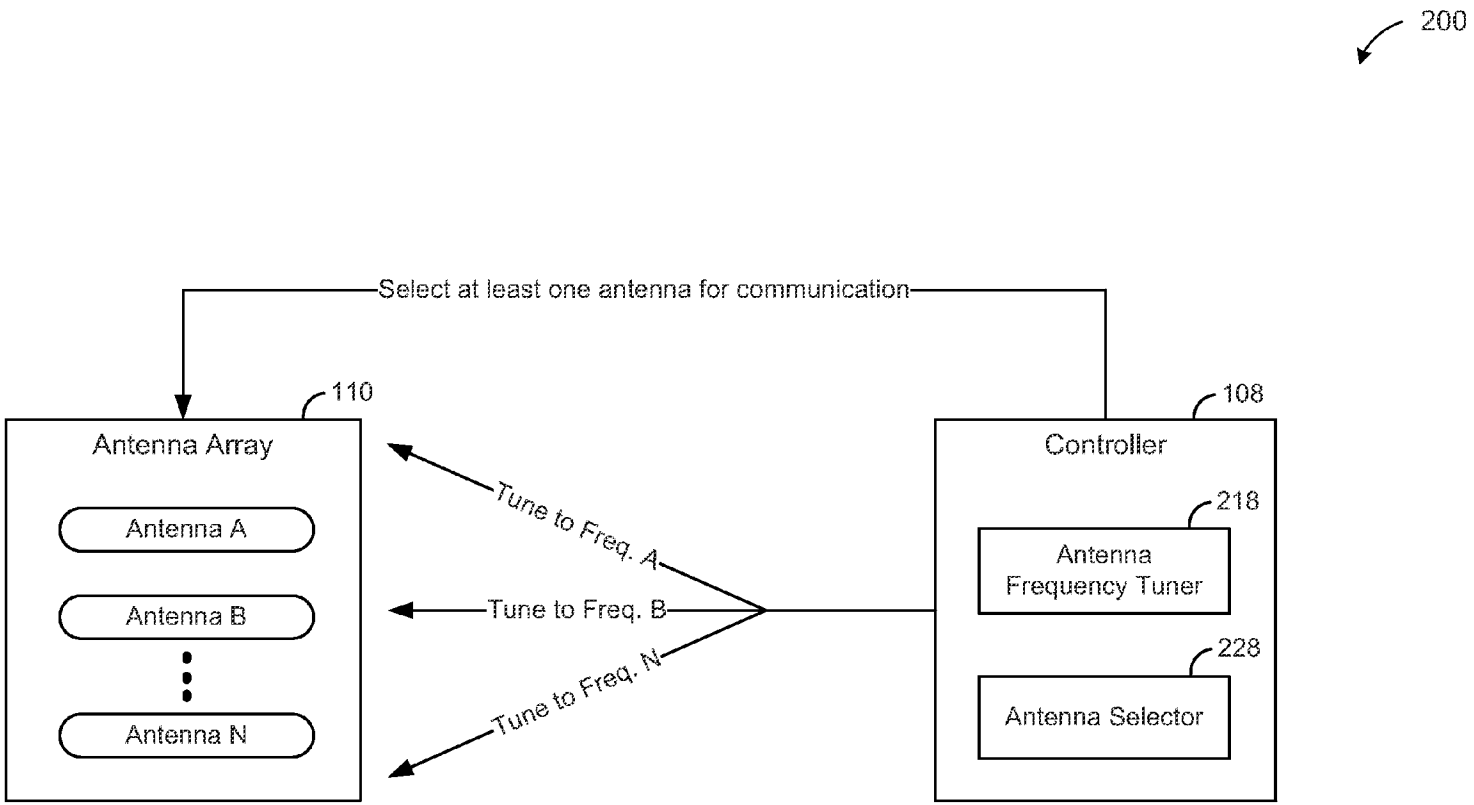
FIG. 2 is a block diagram of an example implementation of a controller for selecting and for tuning multiple antennas mounted on an SMA aperture of a computing device using an SMA socket.

FIG. 2 is a block diagram 200 of an example implementation of a controller for selecting and for tuning multiple antennas mounted on an SMA aperture of a computing device using an SMA socket. The controller 108 includes an antenna frequency tuner 218 and an antenna selector 228. The antenna frequency tuner 218 and the antenna selector 228 may be implemented as hardware, software, or a combination thereof. For example, the antenna frequency tuner 218 and the antenna selector 228 may be implemented as instructions executable by a processor, application specific integrated circuits (ASICs), other special circuitry, or any combination thereof.

The antenna frequency tuner 218 is to tune at least one antenna of the plurality of antennas 110 to a particular operating frequency corresponding to a particular RE technology (e.g., a desired RF technology). For example, the antenna frequency tuner 218 may tune antenna A to a first operating frequency corresponding to a Wi-Fi frequency band, tune antenna B to a second operating frequency corresponding to a GPS frequency band, and so on until the Nth antenna is tuned to an Nth operating frequency corresponding to an Nth desired RF frequency band. Further, more than one antenna may be tuned to a particular operating frequency to achieve a higher signal/data throughput, increased data rates, link range and reliability, or any combination thereof. For example antennas A and B may both be tuned to a Bluetooth frequency band or both may be tuned to any other desired frequency band. Thus, the antenna frequency timer 218 may tune at least one antenna of the plurality of antennas 110 to different operating frequencies or to the same operating frequency.

The antenna selector 228 is to select at least one antenna of the plurality of antennas 110 corresponding to at least one operating frequency for communication. For example, if the computing device 102 is to communicate with a particular RF access point (e.g., Bluetooth, Wi-Fi, GPS, NEC, or the like), the antenna selector 228 may select one or more of the antennas 110 for transmitting and/or receiving data signal from the particular RF access point, peer device, client device, master device, or any combination thereof. Thus, the antenna frequency tuner 218 and the antenna selector 228 of the controller 108, individually or in combination, may be used to manage, control, and configure the plurality of antennas 110.

Figure 3:
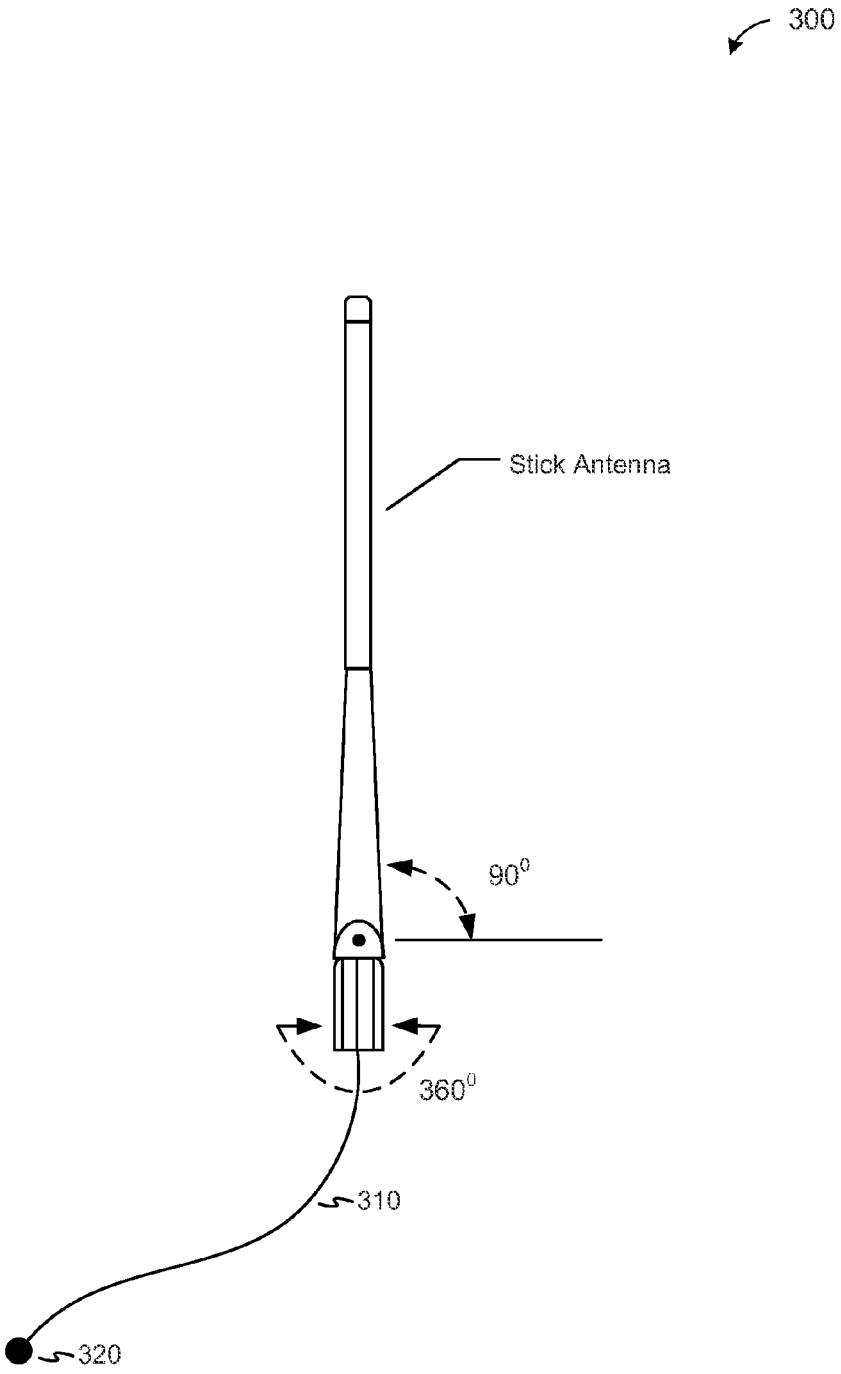
FIG. 3 is a diagram of an example implementation of a stick antenna including a coaxial cable that terminates with a miniature coaxial connector and configured to bend 90 degrees and rotate 360 degrees.

FIG. 3 is a diagram of an example implementation of a stick antenna 300 including a coaxial cable that terminates with a miniature coaxial connector and configured to bend 90 degrees and rotate 360 degrees. Stick antenna 300 includes a coaxial cable 310 at the base of the stick antenna 300 that terminates with a miniature coaxial connector 320. For example, the stick antenna may use a standard micro coaxial cable 310 that terminates with a clip on (mating) miniature coaxial connector that may be easily coupled to the controller 108 (e.g., a PCB). Thus, the stick antenna 300 may be connected to the controller 108 by mounting the stick antenna 108 on one prong of the SMA socket 104 and passing the coaxial cable 310 through the SMA socket 104 to the controller 108. Coaxial connector 320 enables connecting the stick antenna 310 to the controller 108 without any additional connectors such as an SMA connector, thus eliminating any connector loss and improving performance of the stick antenna 300. For example, coaxial connector 320 may be coupled (e.g., by mating) with a corresponding ultra small surface mount coaxial connector on the controller 108, where the surface mount coaxial connector on the controller 108 is a male connector and the coaxial connector 320 is a female connector, or vice versa. Further, the stick antenna 300 may be configured to bend 90 degrees and may include a swivel to rotate the stick antenna 300 360 degrees. The 90 degrees bend and 360 degrees rotation permit changing of the polarization (i.e., changing an orientation) of the stick antenna 300, thereby improving performance of the stick antenna 300. Stick antenna 300 may also be an omnidirectional antenna to radiate radio wave power uniformly in all directions in one plane.

Figure 4:
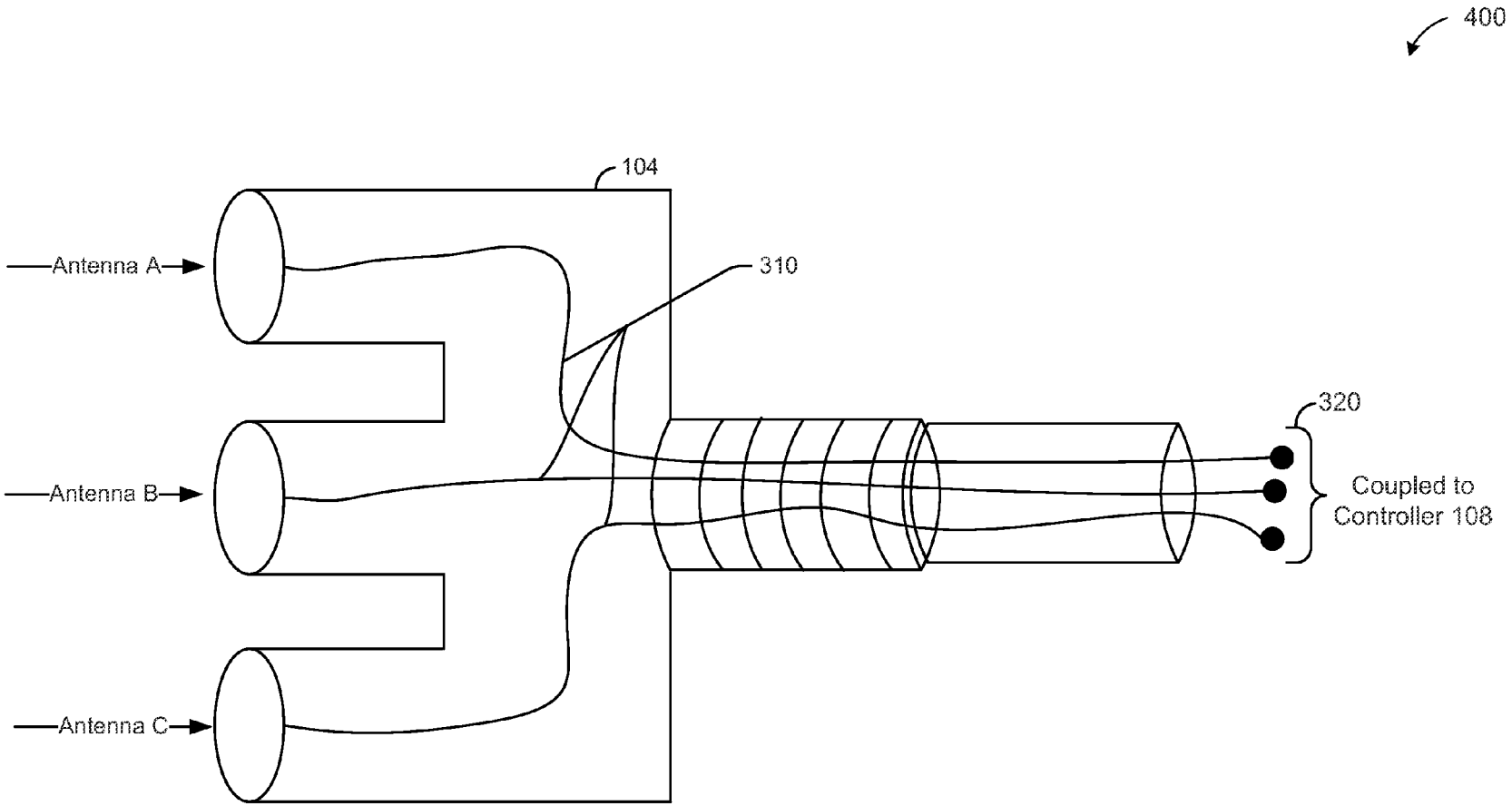
FIG. 4 is a diagram of an example implementation of an SMA socket for mounting a plurality of antennas onto an SMA aperture of a computing device.

FIG. 4 is a diagram 400 of an example implementation of an SMA socket for mounting a plurality of antennas onto an SMA aperture of a computing device. The SMA socket 104 is a multi-pronged device with at least two prongs for mounting multiple antennas 110. For example, SMA socket 104 may be a 3 pronged and may receive multiple stick antennas 300 (e.g., antenna A, antenna B, and antenna C), as shown. It should be noted that SMA socket 104 may be configured to mount as few as 2 stick antennas 300 and as many stick antennas 300 based on a desired number of RF technologies to be implemented.

Further, SMA socket 104 is configured to feed through each coaxial cable 310 of the stick antennas 300 mounted on the SMA socket 104, each coaxial cable terminating with a coaxial connector 320. The SMA socket 104 may be coupled to the SMA antenna connector 106 via the SMA antenna aperture 116. For example, the SMA socket 104 may include a mating connector (e.g., a male connector pin) for coupling to an opposite mating connector (e.g., a female connector sleeve) of the SMA antenna connector 106. The miniature coaxial connectors 320 of the antennas 300 are fed through the SMA socket 104 and coupled to the controller 108. Because the antennas 300 do not include additional SMA or RSMA connectors, signal losses associated with SMA/RSMA connectors may be eliminated or reduced, thereby increasing the performance of the antennas 300.

Figure 5:
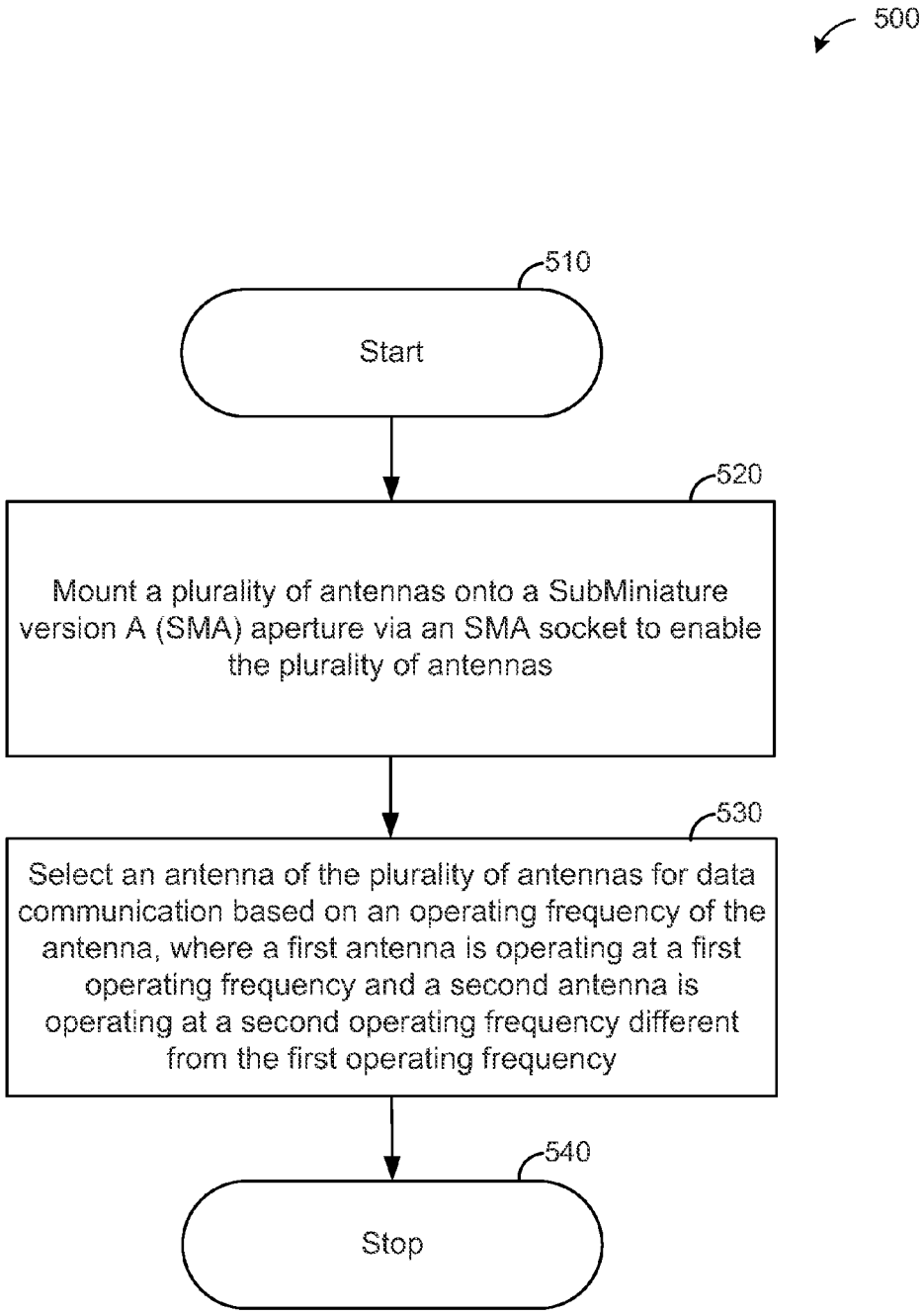
FIG. 5 is a flowchart of an example implementation of a method for mounting multiple antennas onto an SMA aperture of a computing device and for selecting at least one of the multiple antennas for communication.

FIG. 5 is a flowchart of an example implementation of a method 500 for mounting multiple antennas onto an SMA aperture of a computing device and for selecting at least one of the multiple antennas for communication. Although execution of method 500 is described below with reference to the components of computing device 102, other suitable components for execution of method 500 will be apparent to those of skill in the art. Additionally, the components for executing the method 500 may be spread among multiple devices. Method 500 may be implemented in the form of executable instructions stored on a machine-readable storage medium, such as machine-readable storage medium 704 of FIG. 7, in the form of electronic circuitry, or a combination thereof.

Method 500 may start in block 510 and proceed to block 520, where a plurality of antennas 110 are mounted onto an SMA aperture via an SMA socket, to enable the plurality of antennas. For example, multiple stick antennas 300 may be placed on the multi-pronged SMA socket 104 and the SMA socket 104 may be mounted onto the SMA aperture 116. The coaxial cables 310 of the stick antennas 300 may be fed through the SMA socket 104 and connected to the controller 108, where the coaxial cables 310 each terminate with a miniature coaxial connector 320 for coupling to the controller 108.

After mounting the plurality of antennas, method 500 may proceed to block 530, where the controller 108 may select an antenna of the plurality of antennas for data communication based on an operating frequency of the antenna and where a first antenna is operating at first operating frequency and a second antenna is operating at a second operating frequency different from the first operating frequency. For example, each of the mounted stick antennas 300 may be operating at different operating frequencies corresponding to different RFs (e.g., Bluetooth, Wi-Fi, GPS, etc.).

It should be noted that more than one antenna may also be operating in the same frequency, for example, to achieve increased data throughput, antenna diversity, increased link range and reliability, diversity gain, or any combination thereof. Further, the controller 108 may select one or more of the antennas 300 based on a desired RF communication to be implemented by the computing device 102. Thus, for example, if computing device 102 is to initiate a Bluetooth communication, the controller 108 may select one or more of the stick antennas 300 tuned for Bluetooth frequency. Method 500 may then proceed to block 540, where the method 500 stops.

Figure 6:
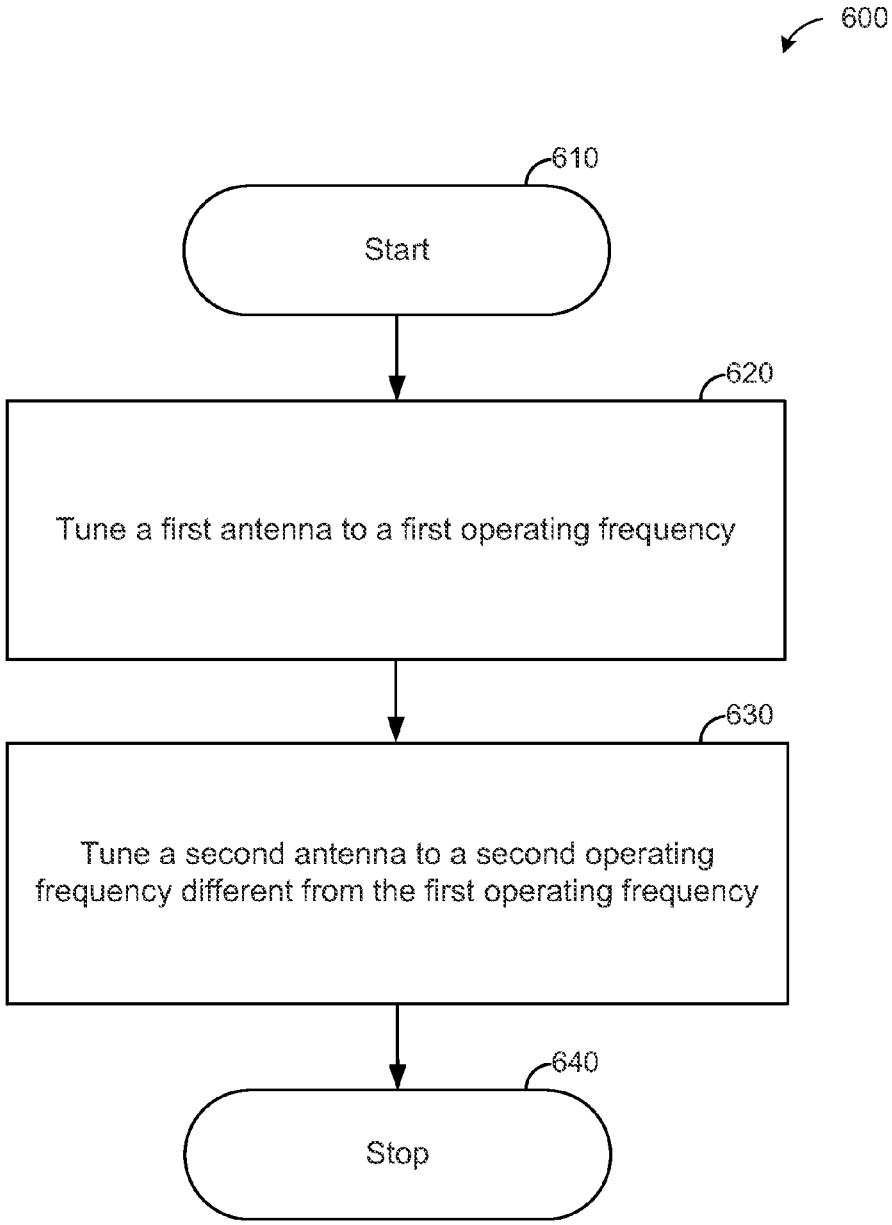
FIG. 6 is a flowchart of an example implementation of a method for mounting multiple antennas onto an SMA aperture of a computing device and for tuning the multiple antennas to operating frequencies.

FIG. 6 is a flowchart of an example implementation of a method for mounting multiple antennas onto an SMA aperture of a computing device and tuning the multiple antennas to desired frequencies. Although execution of method 600 is described below with reference to the components of the computing device 102, other suitable components for execution of method 600 will be apparent to those of skill in the art. Additionally, the components for executing the method 500 may be spread among multiple devices. Method 600 may be implemented in the form of executable instructions stored on a machine-readable storage medium, such as machine-readable storage medium 704 of FIG. 7, in the form of electronic circuitry, or a combination thereof.

Method 600 may start in block 610 and proceed to block 620, where a first antenna is tuned to a first operating frequency. For example, the controller 108 may tune a first stick antenna 300 to a first operating frequency corresponding to a first desired RF technology (e.g., Bluetooth, Wi-Fi, GPS, etc). The method 600 may proceed to block 630, where a second antenna is tuned to a second operating frequency different from the first operating frequency. For example, the controller 108 may tune a second stick antenna 300 to a second operating frequency corresponding to a second desired RF technology different from the first desired RF technology. It should be noted that the controller 108 may also tune the first and second stick antennas 300 to the same operating frequency corresponding to the same RF technology. Method 600 may then proceed to block 640, where the method 600 stops.

Figure 7:
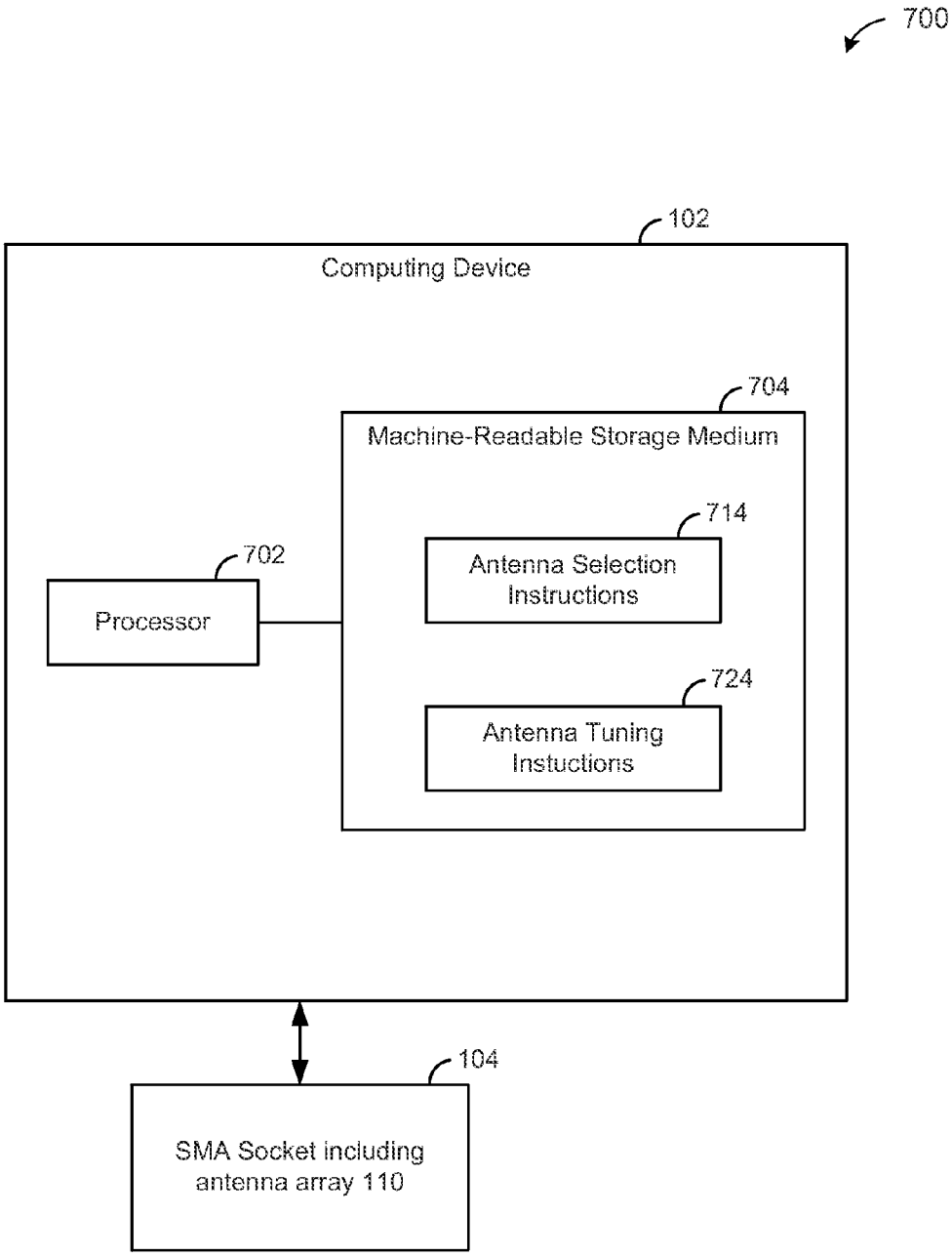
FIG. 7 is a block diagram of an example implementation of a controller including a machine-readable storage medium encoded with instructions for selecting and for tuning multiple antennas mounted an SMA aperture of a computing device using an SMA socket.

FIG. 7 is a block diagram of a computer device including a machine-readable storage medium encoded with instructions for selecting and tuning multiple antennas mounted on an SMA aperture of the computing device. In the embodiment of FIG. 4, computing device 102 includes processor 702 and machine-readable storage medium 704. SMA socket 104 including antenna array 110 may be mounted on the computing device 102 via the SMA antenna aperture 116.

Processor 702 may be a central processing unit (CPU), a semiconductor-based microprocessor, a graphics processing unit (GPU), the controller 108, other hardware devices or processing elements suitable for retrieval and execution of instructions stored in machine-readable storage medium 704, or any combination thereof. Processor 702 may fetch, decode, and execute instructions stored in machine-readable medium 704 to implement the functionality described in detail below. As an alternative or in addition to retrieving and executing instructions, processor 702 may include at least one integrated circuit (IC), other control logic, other electronic circuits, or any combination thereof, that include a number of electronic components for performing the functionality of instructions 714 and 724 stored in machine-readable storage medium 704. Further, processor 702 may include single or multiple cores on a chip, include multiple cores across multiple chips, multiple cores across multiple devices, or any combination thereof.

Machine-readable storage medium 704 may be any electronic, magnetic, optical, or other physical storage device that contains or stores executable instructions. Thus, machine-readable storage medium 704 may be, for example, NVRAM, Random Access Memory (RAM), an Electrically Erasable Programmable Read-Only Memory (EEPROM), a storage drive, a Compact Disc Read Only Memory (CD-ROM), and the like. Further, machine-readable storage medium 704 can be computer-readable as well as non-transitory. As described in detail below, machine-readable storage medium 704 may be encoded with a series of executable instructions for selecting and for tuning multiple antennas mounted on an SMA aperture of the computing device 102. The executable instructions may be, for example, a portion of an operating system (OS) of computing device 102 or a separate application running on top of the OS to select and to tune the multiple antennas.

As another example, the executable instructions may be included in a web browser, such that the web browser implements the functionality described in detail herein. Alternatively, the executable instructions may be implemented in web-based script interpreted by a web-browser, such as JavaScript. Other suitable formats of the executable instructions will be apparent to those of skill in the art.

Machine-readable storage medium 704 may include antenna selection instructions 714, which may be configured to select an antenna of the plurality of antennas on the SMA socket 104 for communication. For example, one or more stick antennas 300 may be selected for one or more RIF communication (e.g., Bluetooth, Wi-Fi, GPS, etc).

Machine-readable storage medium 704 may also include antenna tuning instructions 724, which may be configured to tune a first antenna to a first operating frequency while a second antenna operates (or is tuned) to a second operating frequency different from (or the same as) the first operating frequency. For example, a first stick antenna 300 may be tuned to a first operating frequency corresponding to a first RF technology while a second stick antenna 300 may be operating (or tuned to) a second RF technology, where the first RF technology may be different or the same. To illustrate, the first stick antenna 300 may be tuned to a Bluetooth operating frequency while the second stick antenna 300 is operating in (or tuned to) a GPS operating frequency. In addition, both the first stick antenna 300 and the second stick antenna 300 may be tuned to the same Bluetooth or GPS operating frequency.

According to the embodiments described in details above, design flexibility, scalability, and improved antenna performance may be achieved by providing a means for mounting multiple antennas on a computing device for implementing multiple RF technologies, at a low cost.

What is claimed is:

1. A connector assembly comprising:

a plurality of antennas including a first antenna to operate at a first frequency and a second antenna to operate at a second frequency different from the first frequency;

a SubMiniature version A (SMA) socket to mount the plurality of antennas on an SMA aperture of a computing device, wherein a first of the plurality of antennas is rotatable with respect to the SMA socket independently of a second of the plurality of antennas; and a controller to select at least one antenna of the plurality of antennas corresponding to at least one operating frequency.

2. The connector assembly of claim 1, the controller further to tune the selected at least one antenna to a particular operating frequency.

3. The connector assembly of claim 1, wherein each of the plurality of antennas is a stick antenna configured to rotate with respect to the SMA socket.

4. The connector assembly of claim 3, wherein the stick antenna includes a coaxial cable that terminates with a miniature coaxial connector.

5. The connector assembly of claim 3, wherein the stick antenna is an omnidirectional antenna.

6. The connector assembly of claim 1, wherein the first stick antenna includes a swivel to rotate the first antenna.

7. The connector assembly of claim 1, wherein the plurality of antennas are connected in parallel.

8. The connector assembly of claim 1, wherein the computing device includes a personal digital assistant (PDA), a mobile phone, a portable personal computer, a desktop computer, a multimedia player, an entertainment unit, a data communication device, or any combination thereof.

9. The connector assembly of claim 1, wherein the at least one operating frequency includes a radio frequency.

10. The connector assembly of claim 9, wherein the radio frequency corresponds to one of a Wi-Fi frequency band, a Bluetooth frequency band, a global positioning system (GPS) frequency band, a global system for mobile communications (GSM) frequency band, a universal mobile telecommunications system (UMTS) frequency band, a code division multiple access (CDMA) frequency band, an Institute of Electrical and Electronics Engineers (IEEE) 802.11 frequency band, and a near field communication (NFC) frequency band.

11. The connector assembly of claim 1, the controller further to tune the plurality of antennas to respective frequencies, wherein the tuning of the antenna by the controller includes changing a frequency of the first antenna from another frequency to the first frequency.

12. The connector assembly of claim 1, wherein each of the plurality of antennas includes a respective coaxial cable terminated with a coaxial connector, the coaxial connectors of the respective plurality of antennas being connected to the controller.

13. A method comprising:

mounting a plurality of antennas onto a SubMiniature version A (SMA) aperture of an electronic device via an SMA socket;

tuning, by a controller in the electronic device, the plurality of antennas to respective operating frequencies, wherein the tuning includes changing an operating frequency of a first of the plurality of antennas to a first operating frequency, and wherein the tuning causes the first operating frequency of the first antenna to be different from a second operating frequency of a second of the plurality of antennas; and selecting, by the controller, an antenna of the plurality of antennas for data communication based on the operating frequencies of the plurality of antennas.

14. The method of claim 13, wherein the operating frequencies include radio frequencies.

15. The method of claim 13, wherein each of the plurality of antennas includes a respective coaxial cable terminated with a coaxial connector, the coaxial connectors of the respective plurality of antennas being connected to the controller.

16. The method of claim 13, wherein the first antenna is rotatable with respect to the SMA socket independently of the second antenna.

17. A non-transitory computer readable medium comprising instructions that, when executed by a processor, cause the processor to:

select at least one antenna of a plurality of antennas mounted on a SubMiniature version A (SMA) aperture via an SMA socket; and tune a first antenna to a first operating frequency while a second antenna operates at a second operating frequency different from the first operating frequency.

18. The non-transitory computer readable medium of claim 17, wherein the first operating frequency and the second operating frequency comprise radio frequencies.

19. The non-transitory computer readable medium of claim 17, wherein the first operating frequency corresponds to a first channel of a particular radio frequency band, wherein the second operating frequency corresponds to a second channel of the particular radio frequency band.

20. The non-transitory computer readable medium of claim 17, wherein the tuning of the first antenna caused by execution of the instructions includes changing an operating frequency of the first antenna from another operating frequency to the first operating frequency.

* * * * *

UNITED STATES PATENT AND TRADEMARK OFFICE

CERTIFICATE OF CORRECTION

PATENT NO. : 8,842,049 B2
APPLICATION NO. : 13/458358
DATED : September 23, 2014
INVENTOR(S) : Rajat Sandeshkumar Anand It is certified that error appears in the above-identified patent and that said Letters Patent is hereby corrected as shown below:

In the Claims

In column 8, line 33, in Claim 6, delete “stick antenna” and insert -- antenna --, therefor.

Signed and Sealed this
Twenty-seventh Day of January, 2015

Michelle K. Lee

Michelle K. Lee
*Deputy Director of the United States Patent and Trademark Office*